US006345987B1

(12) United States Patent
Mori et al.

(10) Patent No.: US 6,345,987 B1
(45) Date of Patent: Feb. 12, 2002

(54) ELECTRICAL CONNECTOR

(75) Inventors: Teruyuki Mori; Hirohisa Takano; Kenji Narita, all of Kanagawa (JP)

(73) Assignee: Kyocera Elco Corporation, Kanagawa (JP)

( * ) Notice: Subject to any disclaimer, the term of this patent is extended or adjusted under 35 U.S.C. 154(b) by 0 days.

(21) Appl. No.: 09/602,801

(22) Filed: Jun. 23, 2000

(30) Foreign Application Priority Data

Jun. 25, 1999 (JP) ..... 11-179892

(51) Int. Cl.[7] ..... H01R 12/00
(52) U.S. Cl. ..... 439/66
(58) Field of Search ..... 439/66, 65; 361/784, 361/789

(56) References Cited

U.S. PATENT DOCUMENTS 5,139,427 A * 8/1992 Boyd et al. ..... 439/66
5,259,769 A * 11/1993 Cruise et al. ..... 439/65
6,022,224 A * 2/2000 Peters ..... 439/66
6,031,730 A * 2/2000 Kroske ..... 361/784
6,038,140 A * 3/2000 Petri ..... 361/804
6,045,367 A * 4/2000 Maldonado ..... 439/66
6,062,871 A * 5/2000 Arai et al. ..... 439/66
6,068,517 A * 5/2000 Tanaka ..... 439/660
6,077,130 A * 6/2000 Hughes et al. ..... 439/862
6,077,089 A * 7/2000 Bishop et al. ..... 439/66
6,146,152 A * 11/2000 McHugh et al. ..... 439/66

* cited by examiner

*Primary Examiner*—Tulsidas Patel
(74) *Attorney, Agent, or Firm*—McCormick, Paulding & Huber LLP

(57) ABSTRACT

A connector includes a connector body made of an electrically insulating material, having a contact support wall whose one end defines a contact mount portion, and a contact made of an electrically conductive material, having a pair of resilient contact elements located on upper and lower sides of the contact support wall, and a resilient support portion which connects the resilient contact elements and which is elastically supported by the contact mount portion. The resilient support portion of the contact is engaged with the contact support wall so that the entire contact can swing about the contact mount portion.

8 Claims, 2 Drawing Sheets

ELECTRICAL CONNECTOR

BACKGROUND OF THE INVENTION

1. Field of the Invention

The present invention relates to a connector for connecting terminals on, for example, two substrates (elements).

2. Description of the Related Art

For instance, a flexible printed circuit (FPC) board or a flexible flat cable (FFC) is used to interconnect terminals of different substrates. However, the FPC board or FFC requires a separate connector to establish an electrical connection to the substrate, thus resulting in an increase in the manufacturing cost.

SUMMARY OF THE INVENTION

It is an object of the present invention to provide a connector which can easily connect terminals of different substrates (elements) without using an FPC board or FFC, etc.

To achieve the object, according to an aspect of the present invention, a connector is provided, which includes a connector body made of an electrically insulating material, having a contact support wall whose one end defines a contact mount portion, and a contact made of an electrically conductive material, having a pair of resilient contact elements located on upper and lower sides of the contact support wall, and a resilient support portion which connects the resilient contact elements, and which is elastically supported by the contact mount portion. The resilient support portion of the contact is engaged with the contact support wall so that the entire the contact can swing about the contact mount portion.

According to another aspect of the present invention, a connector is provided, which includes a substantially rectangular connector body made of an electrically insulating material; an array of contact grooves having pairs of adjacent contact grooves formed on upper and lower surfaces of the substantially rectangular connector body, wherein contact support walls are formed between the adjacent contact grooves; and contacts made of an electrically conductive material, corresponding to the contact support walls. Each of the contacts are provided with a pair of resilient contact elements which extend from the upper and lower surfaces of the contact support walls in opposite directions, and each of the contacts includes a resilient support portion which connects the resilient contact elements and which are elastically supported by a contact mount portion of the substantially rectangular connector body. The resilient support portions of the contacts being each engaged with the corresponding contact support wall so that the entire the contact can swing about the corresponding contact mount portion thereof.

In the above aspects of the present invention, preferably, the connector can be connected to a first substrate having a terminal, wherein in the case where the connector is connected to the first substrate, one of the pair of resilient contact elements contacts the terminal to be depressed thereby. Furthermore, the connector can be connected to a second substrate having a terminal, wherein in the case where the connector is connected to the second substrate, the other of the pair of resilient contact elements contacts the terminal of the second substrate to be depressed thereby.

The present disclosure relates to subject matter contained in Japanese Patent Application No.11-179892 (filed on Jun. 25, 1999) which is expressly incorporated herein by reference in its entirety.

BRIEF DESCRIPTION OF THE DRAWINGS

The invention will be described below in detail, with reference to the accompanying drawings, in which.

DESCRIPTION OF THE PREFERRED EMBODIMENT

Figure 1:
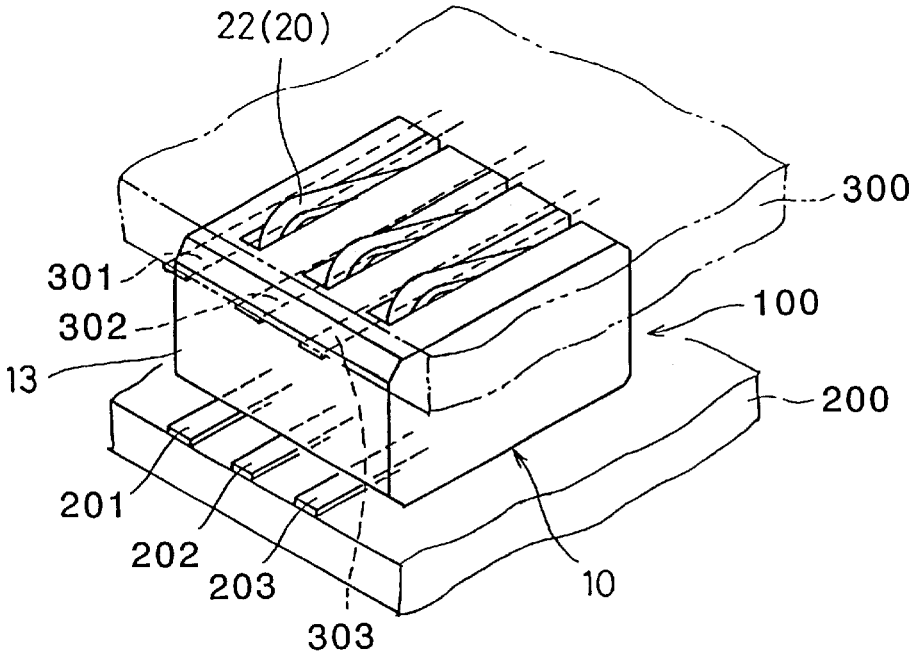
FIG. 1 is a perspective view of a connector and a pair of substrates which are connected by the connector, according to an embodiment of the present invention.
Figure 2:
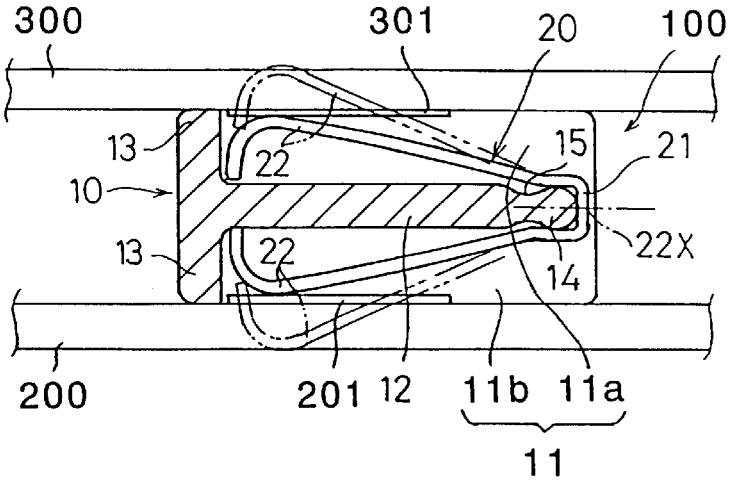
FIG. 2 is a sectional view of FIG. 1 shown in a connected state.
Figure 3:
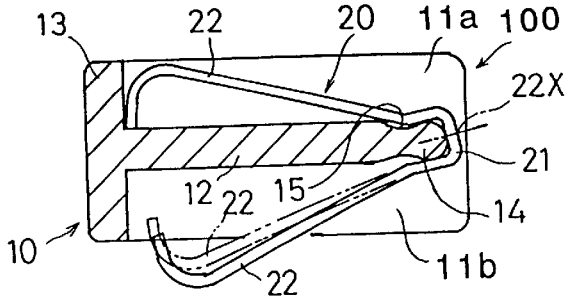
FIG. 3 is a sectional view of FIG. 1, in which a pressing force is applied to only one of resilient contact elements of a contact; and, FIG. 4 is a partially exploded view of a connector and a pair of substrates which are connected by the connector, according to another embodiment of the present invention.

FIGS. 1 through 3 show an embodiment of a connector 100 according to the present invention. The connector 100 includes a connector body 10 made of insulating plastic material, and contacts (three contacts in the illustrated embodiment) 20 supported by the connector body 10.

The connector body 10 is generally substantially rectangular and is formed so as to be symmetrical with respect to a median plane thereof in the thickness direction (see FIG. 2). The connector body 10 is provided, on its upper and lower surfaces, with three rows of contact grooves (array of contact grooves) 11. Each contact groove 11 includes an upper and lower contact groove (adjacent contact grooves) 11*a* and 11*b*, respectively. The contact grooves 11 are spaced at an equi-distance. Consequently, three contact support walls 12 are defined between the upper and lower contact grooves 11*a* and 11*b*. In the illustrated embodiment, the contact grooves 11 are each provided with an end wall portion in the longitudinal direction of the connector body 10, so that a pair of contact protection walls (excess deformation prevention walls) 13 integral with each other and extending in opposite directions perpendicular to the contact support walls 12 are formed. In other words, the contact support walls 12 and the contact protection walls 13 define a generally T-shape cross section. The ends of the contact support walls 12 opposed to the contact protection walls 13 define contact mounting portions 14.

The contact 20 which is made of an electrically conductive metal has symmetrical upper and lower halves, i.e., is provided with a resilient support portion 21 which is attached to the contact mount portion 14 of the connector body 10 and a pair of resilient contact arms (resilient contact elements) 22 which extend from the opposed ends of the support portion 21 in the direction away from the contact support wall 12. The resilient contact arms 22 project outward, in its free state, from the upper and lower surfaces of the connector body 10, so that when the inward force is applied thereto, the resilient contact arms 22 can be elastically deformed into the contact grooves 11.

The resilient support portion 21 of the contact 20 is generally U-shaped along the periphery of the contact mount portion 14 (upper and lower surfaces and an end surface in the vertical direction as shown in FIG. 2). Upon mounting the resilient support portion 21 to the connector support wall 12 (contact mount portion 14), if one of the resilient contact arms 22 is pressed inward, not only can the resilient contact arm be elastically deformed but also the entire contact 20 can be rotated (swung) so that the center axis 22X of the resilient contact arms 22 is tilted in the direction of depression thereof. Namely, the resilient contact arms 22 do not have a press-fit portion which is press-fitted onto a portion of the contact body 10, rather, the resilient contact arms 22 are supported by the contact mount portion 14 without being secured (press-fitted) thereto in order to exhibit a resiliency over the entire length thereof. To facilitate the swing movement of the contact 20, the contact support wall 12 (contact mount portion 14) is provided on its upper and lower surfaces with a pair of recesses 15. The sectional shape of the resilient support portion 21 is not limited to a U-shape and can be an arc or knob-shaped, etc.

The connector 100 constructed as above is disposed between terminals 201, 202 and 203 of a substrate (element) 200 and terminals 301, 302 and 303 of a substrate (element) 300, so that the connector 100 is held between the pair of substrates 200 and 300 to be interconnected. Namely, the terminals 201, 202, and 203 of the substrate 200 and the corresponding terminals 301, 302 and 303 of the substrate 300 are brought into contact with the pairs of resilient contact arms 22 of the three contacts 20 that project outward from the upper and lower surfaces of the connector body 10 of the connector 100, and in this state, the substrates 200 and 300 are pressed onto the connector 100 (connector body 10). Consequently, the resilient contact arms 22 are elastically deformed and are retracted into the contact grooves 11. Thus, the terminals 201, 202, 203 and the terminals 301, 302, 303 are electrically connected through the corresponding contacts 20. Note that positioning device between the substrate connector 100 and the substrates 200 and 300 are separately provided.

The deformation of the contact 20 includes not only an elastic deformation of a pair of resilient contact arms 22 about the center axis 22X, but also a swing movement or rotation of the entire contact 20 so that the center axis 22X tilts. Therefore, the contact 20 can provide sufficient resiliency even if the size thereof is reduced. Also, it is possible to uniformly apply a load to the pair of resilient contact arms 22.

For the sake of comparison, supposing that the contact 20 is provided with a pair of press-fit projections, each projection being provided on the resilient support portion 21. The pair of press-fit projections are press-fitted into the upper and lower contact grooves 11*a* and 11*b* of the contact support wall 12 of the connector body 10. In this case, the portion between the pair of press-fit projections do not function as resilient members. Therefore, even if the contact 20 is long, the effective length which serves as a spring is reduced, so that it is difficult to obtain a sufficient amount of deformation, thus resulting in a possible failure of connection or an occurrence of buckling. However, in the present invention, since the contact 20 is swingable or rotatable about the center axis 22X, the contact 20 serves as a spring over the entire length thereof, and hence even if the contact is small or short, a necessary amount of deformation can be obtained. Consequently, no failure of connection nor buckling occurs.

Figure 4:
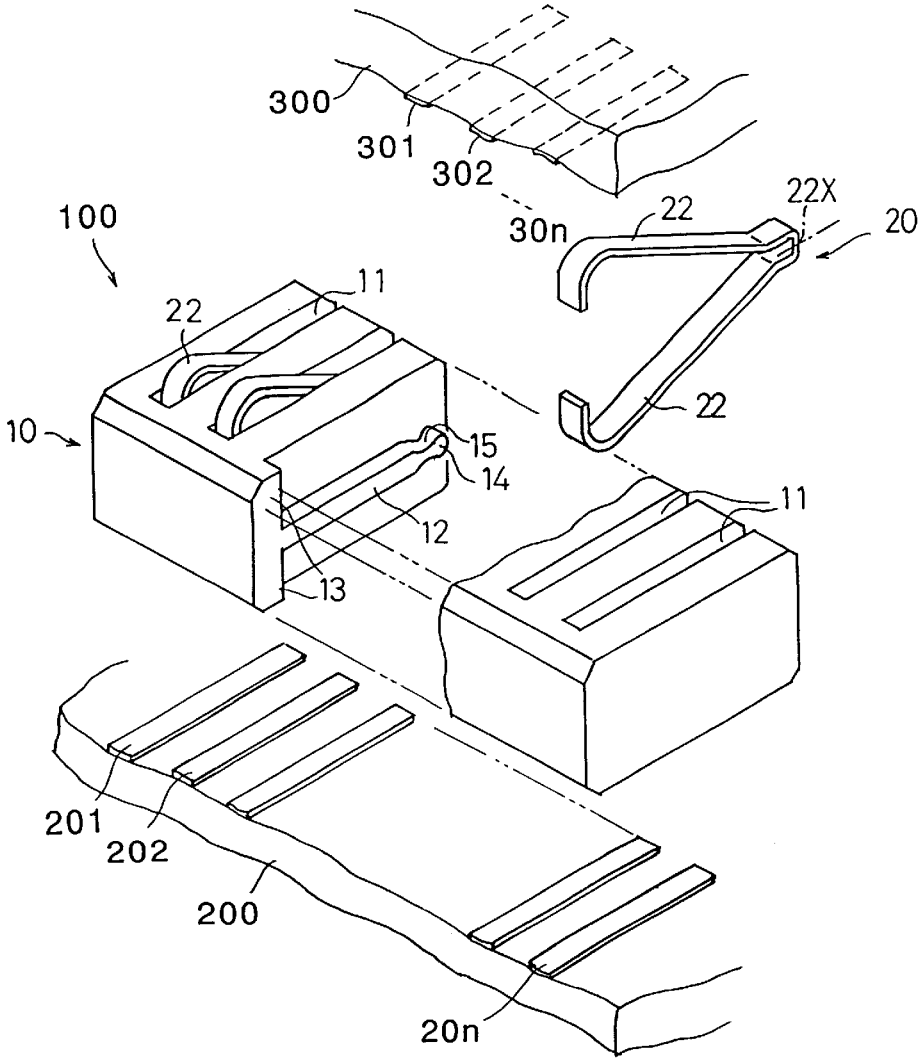

FIG. 4 shows another embodiment of the present invention. In this embodiment, the substrate connector 100 is applied to the substrates (elements) 200 and 300 having a larger number of terminals 201, 202, 203, . . . 20*n*, and 301, 302, 303 . . . 30*n*, respectively. The connector body 10 is provided with the same number of contact grooves 11 as the terminals. The pitch of the contact grooves 11 corresponds to that of the terminals. The connector 20 is inserted and held in each contact groove 11.

In the second embodiment mentioned above, the connector body 10 is provided with the contact support walls 12 defined by the contact grooves 11. The contact support walls 12 are provided on one end thereof with upper and lower contact protection walls 13 extending in opposite directions. The contact grooves 11 are practically adapted to determine the position and pitch of the contacts 20 and to protect the contacts 20. It is preferable that the contact protection walls 13 be provided to reliably prevent the contacts 20 from being contacted by foreign matter. However, since the width of each contact groove 11 is reduced to meet the requirement of miniaturization of the connector 100, the possibility that foreign matter enters the contact grooves 11 is reduced and hence the contact protection walls 13 can be dispensed with. Also, the substrates 200 and 300 can be any elements other than substrates.

As may be understood from the foregoing, according to the present invention, the terminals of different substrates can be easily connected by the connector without using an FPC board or FFC.

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A connector comprising:

a connector body made of an electrically insulating material, having a contact support wall whose one end defines a contact mount portion; and a contact made of an electrically conductive material, having a pair of resilient contact elements located on upper and lower sides of the contact support wall, and a resilient support portion which connects the resilient contact elements, and which is elastically supported by the contact mount portion;

said resilient support portion of the contact being engaged with the contact support wall so that the entire said contact can swing about the contact mount portion.

2. The connector according to claim 1, wherein said connector can be connected to a first substrate having a terminal;

wherein in the case where said connector is connected to said first substrate, one of said pair of resilient contact elements contacts said terminal to be depressed thereby.

3. The connector according to claim 2, wherein said connector can be connected to a second substrate having a terminal;

wherein in the case where said connector is connected to said second substrate, the other of said pair of resilient contact elements contacts said terminal of the second substrate to be depressed thereby.

4. A connector comprising:

a substantially rectangular connector body made of an electrically insulating material;

an array of contact grooves including pairs of adjacent contact grooves formed on upper and lower surfaces of the substantially rectangular connector body, wherein contact support walls are formed between the adjacent contact grooves; and contacts made of an electrically conductive material, corresponding to the contact support walls;

wherein each of said contacts are provided with a pair of resilient contact elements which extend from the upper and lower surfaces of the contact support walls in opposite directions, and each of said contacts includes a resilient support portion which connects the resilient contact elements and which are elastically supported by a contact mount portion of the substantially rectangular connector body;

said resilient support portions of the contacts being each engaged with the corresponding contact support wall so that the entire said contact can swing about the corresponding contact mount portion thereof.

5. The connector according to claim 4, wherein said connector can be connected to a first substrate having a terminal;

wherein in the case where said connector is connected to said first substrate, one of said pair of resilient contact elements contacts said terminal to be depressed thereby.

6. The connector according to claim 5, wherein said connector can be connected to a second substrate having a terminal;

wherein in the case where said connector is connected to said second substrate, the other of said pair of resilient contact elements contacts said terminal of the second substrate to be depressed thereby.

7. The connector according to claim 1, wherein the contact mount portion has an upper surface defining a recess and a lower surface defining a recess for facilitating the swinging of the entire contact about the contact mount portion.

8. The connector according to claim 4, wherein each contact mount portion has an upper surface defining a recess and a lower surface defining a recess for facilitating the swinging of the corresponding entire contact about the contact mount portion.

* * * * *